US007389808B2

(12) United States Patent
Renkel et al.

(10) Patent No.: US 7,389,808 B2
(45) Date of Patent: Jun. 24, 2008

(54) METHOD FOR PRODUCING A CAST COMPONENT

(75) Inventors: Manfred Renkel, Wiesenthau (DE); Wilfried Smarsly, München (DE)

(73) Assignee: G4T GmbH, Bad Staffelstein (DE)

( * ) Notice: Subject to any disclaimer, the term of this patent is extended or adjusted under 35 U.S.C. 154(b) by 0 days.

(21) Appl. No.: 11/632,774

(22) PCT Filed: Jul. 16, 2005

(86) PCT No.: PCT/DE2005/001256

§ 371 (c)(1),
(2), (4) Date: Mar. 6, 2007

(87) PCT Pub. No.: WO2006/010356

PCT Pub. Date: Feb. 2, 2006

(65) Prior Publication Data

US 2007/0261813 A1 Nov. 15, 2007

(30) Foreign Application Priority Data

Jul. 23, 2004 (DE) ..... 10 2004 035 892

(51) Int. Cl.
*B22D 27/00* (2006.01)

(52) U.S. Cl. ..... 164/57.1; 164/55.1

(58) Field of Classification Search ..... 164/55.1, 164/56.1, 57.1
See application file for complete search history.

(56) References Cited

U.S. PATENT DOCUMENTS

| | | | | |
|---|---|---|---|---|
| 4,668,470 | A * | 5/1987 | Gilman et al. | 419/32 |
| 5,397,533 | A * | 3/1995 | Morikawa et al. | 420/418 |
| 5,819,839 | A | 10/1998 | Mihelich et al. | |
| 5,839,504 | A | 11/1998 | Matsuda | |

* cited by examiner

*Primary Examiner*—Kuang Lin
(74) *Attorney, Agent, or Firm*—Manabu Kanesaka

(57) ABSTRACT

The invention relates to a method for producing a cast component, particularly a gas turbine component, by casting. According to the invention, the method comprises at least the following steps: a) preparing a melting crucible; b) preparing a semifinished granular material from an intermetallic titanium/aluminum material; c) filling the melting crucible with the semifinished granular material, whereby the quantity of the semifinished granular material placed inside the melting crucible corresponds to the quantity necessary for casting the component; d) melting the semifinished granular material made of the intermetallic titanium/aluminum material inside the melting crucible; e) preparing a casting mold; f) pouring the melt into the casting mold; g) solidifying the melt inside the casting mold, and; h) removing the cast component from the casting mold.

4 Claims, No Drawings

METHOD FOR PRODUCING A CAST COMPONENT

The invention relates to a method for producing a cast component.

BACKGROUND OF THE INVENTION

The present invention relates to the production of components from an intermetallic titanium-aluminum material, in particular the production of gas turbine components, using a casting method. During casting, molds, so-called casting molds, are used, wherein the casting molds have an interior contour which corresponds to the exterior contour of the component to be produced. In principle, a distinction is made between casting methods which use lost casting molds and casting methods which use permanent casting molds. With casting methods which use lost casting molds, only one component can be produced with one casting mold. With darting methods which use permanent casting molds, the casting molds can be used multiple times. So-called precision casting, among others, belongs to the casting methods which use lost casting molds. Reference is made here to gravity casting as an example of casting methods which use permanent casting molds.

During the technical casting production of components from an intermetallic titanium-aluminum material, the procedure in accordance with prior art is that a melting crucible is filled with a semifinished material, wherein in accordance with prior art the semifinished material consists of rods of the intermetallic material which are produced from pellets of the metallic elements by arc melting or electron-beam melting. The production of these semifinished materials and thus the production of the cast component is very cost-intensive, wherein the quality of the material is very dependent on the melting technology used to provide the semifinished material. In accordance with prior art, the rod-shaped semifinished material for filling a melting crucible is broken up by spark erosion or by water jet cutting, whereby the quantity of the rod-shaped semifinished material which is placed in the melting crucible is adjusted to the dimensions of the melting crucible. This results in a cost-intensive filling of the melting crucible during the production of cast components made of intermetallic materials.

Assuming this, the present invention is based on the problem of creating a novel method of producing a cast component.

SUMMARY OF THE INVENTION

This problem is solved by a method in accordance with the present invention. As provided by the invention, the method comprises of at least the following steps: a) providing a melting crucible; b) providing a semifinished granular material from an intermetallic titanium-aluminum material; c) filling the melting crucible with the semifinished granular material, wherein the quantity of the semifinished granular material placed in the melting crucible corresponds to the quantity required for casting the component; d) melting the semifinished granular material made of the intermetallic titanium-aluminum material in the melting crucible; e) providing a casting mold; f) pouring the melt into the casting mold; g) solidifying the melt in the casting mold; h) removing the cast component from the casting mold.

In the sense of the present invention, it is suggested to provide a semifinished granular material made of intermetallic titanium-aluminum material for producing an intermetallic cast component. The shape of the granular material offers considerable advantages over the rod shape known from prior art. A semifinished material with a granular shape can be handled more flexibly. Furthermore, a continuous melting and casting operation can be established by using a granular-shaped, semifinished material. Furthermore, in the sense of the invention, a melting crucible is filled with the semifinished granular material such that the quantity of semifinished granular material poured into the melting crucible precisely corresponds to the quantity required for casting the component. The quantity of semifinished material poured into the melting crucible is thus not adjusted to the melting crucible dimension according to prior art, but rather to the component to be produced. This results in considerable cost advantages.

DETAILED DESCRIPTION OF PREFERRED EMBODIMENTS

Hereinafter, the present method for the production of cast components, in particular gas turbine cast components, will be described in more detail.

During the technical casting production of a component made from an intermetallic titanium-aluminum material, the procedure is that a melting crucible is provided in a first step. In a second step a semifinished granular material made of an intermetallic titanium-aluminum material is provided.

During the provision of the semifinished granular material made of the intermetallic titanium-aluminum material, the procedure is that titanium oxide and aluminum oxide are reduced to element powders, namely to titanium powder and aluminum powder, in a reduction process using magnesium and/or calcium. The reaction products magnesium oxide and/or calcium oxide are then removed or separated, in particular filtered out, from the aluminum melt as well as the titanium melt. The aluminum as well as the titanium are then ground and heat-treated at a temperature below the melting temperature of aluminum as well as titanium. The solid state reaction associated herewith converts the titanium powder and aluminum powder into an intermetallic titanium-aluminum granular material ($Ti_x$—$Al_y$ granular material).

In contrast to the provision of the rod-shaped semifinished materials known from prior art, the production of such a semifinished granular material from an intermetallic titanium-aluminum material has the advantage that the semifinished material exhibits much less fluctuations in the alloy components. The semifinished granular material is produced without the melting processes which are required according to prior art which offers the advantage that an evaporation of alloy components as well as reactions of the alloy components which occur during the melting processes are avoided. Furthermore a granular-shaped semifinished material is much easier to handle and further process than a rod-shaped semifinished material.

After the provision of the semifinished granular material from the intermetallic titanium-aluminum material, the provided melting crucible is filled with the semifinished granular material, wherein the quantity of semifinished granular material which is poured into the melting crucible precisely corresponds to the quantity necessary for casting the component to be produced.

According to a further aspect of the present invention, the semifinished granular material is held ready in boxes located above the melting crucible. At least one of the boxes is opened and emptied to fill the melting crucible, wherein the semifinished granular material then enters the melting crucible. After such a box is emptied, same can be filled again with semifinished granular material regardless of the further processing of the semifinished granular material in melting crucible as well as casting mold. This significantly increases the flexibility of the casting process.

After the melting crucible has been filled with semifinished granular material, the semifinished granular material made of the intermetallic titanium-aluminum material is melted in the melting crucible. The melting crucible is also called a cold-wall crucible. The molten semifinished granular material in the melting crucible is poured as melt into a casting mold, wherein the melt solidifies in the casting mold and then the cast component is removed from the casting mold.

The method provided by the invention is preferably used to produce gas turbine components, in particular during the production of blades for aircraft engines, from an intermetallic titanium-aluminum material. The method provided by the invention can significantly increase the quality of the components produced technically by casting from the titanium-aluminum material. Furthermore the flexibility of the casting method is increased and a cost advantage results in comparison to the method known from prior art.

The invention claimed is:

1. Method for the production of a cast component, comprising the steps of:

a) providing a melting crucible;

b) producing a semifinished granular material from an intermetallic titanium aluminum material by reducing titanium oxide and aluminum oxide to titanium powder and aluminum powder, then grinding the titanium powder and the aluminum powder and converting these into an intermetallic $Ti_x$-$Al_y$ granular material by a heat treatment at a temperature below the melting temperature of these elements;

c) filling the melting crucible with semifinished granular material, wherein quantity of the semifinished granular material placed in the melting crucible corresponds to quantity required for casting the component;

d) melting the semifinished granular material made of the intermetallic titanium aluminum material in the melting crucible;

e) providing a casting mold;

f) pouring melt into the casting mold;

g) solidifying the melt in the casting mold;

h) removing the cast component from the casting mold.

2. Method according to claim 1, wherein reduction of titanium oxide and aluminum oxide to titanium powder and aluminum powder is performed using magnesium and/or calcium, and wherein reaction products magnesium oxide and/or calcium oxide are removed before the titanium powder and aluminum powder are ground.

3. Method according to claim 1, wherein the semifinished granular material is held ready in boxes located above the melting crucible, and wherein at least one of the molding boxes is opened and emptied to fill the melting crucible.

4. Method according to claim 3, wherein after the emptying of the box or each box and during the melting of the semifinished granular material in the melting crucible, the box or each box is filled again with semifinished granular material.

* * * * *